US005437369A

United States Patent [19]

Spitere

[11] Patent Number: 5,437,369

[45] Date of Patent: Aug. 1, 1995

[54] TOOL BUCKET WITH TOOL-LOCKING HANDLE

[76] Inventor: Thomas C. Spitere, 5393 Walton Heath, Las Vegas, Nev. 89122

[21] Appl. No.: 159,537

[22] Filed: Dec. 1, 1993

[51] Int. Cl.[6] ..... B65D 85/20

[52] U.S. Cl. ..... 206/373; 206/375; 220/603; 220/754; 220/756; 220/759

[58] Field of Search ..... 206/372, 373, 376–379, 206/375; 220/754, 756, 759, 603; 312/901, 244, 280; 211/70.6, 60.1, 66, 65

[56] References Cited

U.S. PATENT DOCUMENTS

| | | | |
|---|---|---|---|
| 481,188 | 8/1892 | Northam | 211/60.1 |
| 1,595,105 | 8/1926 | Lawrence | 312/244 |
| 1,629,213 | 5/1927 | Hughes . | |
| 1,639,227 | 8/1927 | Lawrence | 206/373 |
| 2,551,780 | 5/1951 | Wood | 206/315.3 |
| 2,823,971 | 2/1958 | Hoyt . | |
| 3,104,010 | 9/1963 | Pence | 220/754 X |
| 4,388,996 | 6/1983 | Panicci | 220/603 |
| 4,416,372 | 11/1983 | Polk | 206/372 |
| 4,437,568 | 3/1984 | Hamblin | 206/223 |
| 4,666,202 | 5/1987 | Theodorides | 312/244 X |
| 4,826,007 | 5/1989 | Skeie | 206/373 |
| 4,867,332 | 9/1989 | Mains | 206/372 X |
| 4,874,119 | 10/1989 | Winter . | |
| 4,911,295 | 3/1990 | Venegoni | 206/372 |
| 4,925,026 | 5/1990 | McKay | 206/373 |
| 4,993,551 | 2/1991 | Lindsay | 206/373 |
| 5,011,013 | 4/1991 | Meisner et al. . | |
| 5,139,144 | 8/1992 | Robert, Jr. | 206/378 |
| 5,186,329 | 2/1993 | Fogelberg | 206/372 |
| 5,242,050 | 9/1993 | Billings | 206/373 X |

FOREIGN PATENT DOCUMENTS

| | | | |
|---|---|---|---|
| 645628 | 10/1928 | France | 220/754 |

*Primary Examiner*—Bryon P. Gehman
*Attorney, Agent, or Firm*—Weiner, Carrier & Burt; William F. Esser; Joseph P. Carrier

[57] ABSTRACT

A tool carrying device for holding tools having a wide variety of sizes and shapes in an organized manner. The device includes a container, a shelf for holding tools in an upright manner, and a pocket with cooperating bracket for holding large, elongated tools externally to the container. A handle provided at the upper end of the container serves the dual purpose of locking externally disposed tools to the container.

9 Claims, 4 Drawing Sheets

TOOL BUCKET WITH TOOL-LOCKING HANDLE

BACKGROUND OF THE INVENTION

1. Field of the Invention

This invention relates to a device for storing and carrying tools, and particularly to a tool bucket that provides safe, secure, and efficient storage of tools having any of a number of sizes and shapes.

2. Description of the Relevant Art

There are known inventions of devices for storing tools. For example, Hughes U.S. Pat. No. 1,629,213 discloses a device which holds paint brushes in an upright position in an air-tight environment. The Hughes invention, however, fails to provide a device for storing tools having a wide variety of shapes and sizes.

In addition, Hoyt U.S. Pat. No. 2,823,971 discloses a tackle box having a plurality of drawers and compartments. The Hoyt invention, however, fails to provide a device for storing a wide assortment of tools in an efficient, secure, and organized manner.

Further, Winter U.S. Pat. No. 4,874,119 discloses a device for holding tools in various pockets, but fails to disclose a device for storing tools having a wide variety of shapes and sizes.

Still further, Meisner U.S. Pat. No. 5,011,013 discloses a storage container having a plurality of trays. The Meisner invention, however, fails to provide a device for storing a wide variety of tools in an efficient and orderly manner.

SUMMARY OF THE INVENTION

The present invention overcomes the above-discussed limitations and shortcomings of known tool holders and thereby satisfies a significant need for such a holder which stores a variety of tools in an efficient, orderly, safe, and secure manner.

According to the present invention, there is provided a tool bucket storage device that comprises a cylindrical container having a cylindrical shelf adapted to fit therein; a removable circular tray adapted to hold small tools or other related items; a lid pivotally attached to the container; a chain, both ends of which are secured to the exterior of the container so as to form a handle; and an external bracket/pocket assembly for holding elongated tools which would not necessarily efficiently fit within the container.

In use, larger tools or tools having unorthodox shapes are first placed in the bottom of the container. Next, elongated tools are placed on the cylindrical shelf and are held thereon in a substantially upright position by shelf dividers. Thereafter, the circular tray is placed on its associated supports in the container and small tools or related items are placed in the partitioned areas of the tray. The lid may be then closed and optionally locked to protect the tools from theft. Further, relatively large, elongated tools may be slid between the exterior bracket and the container and inserted in the exterior pocket and secured therein.

Still further, one end of the chain may be optionally extended beyond one point at which the chain is attached to the container and adapted to be inserted through an aperture of the elongated tool to lock the tool to the container.

Alternatively, one end of the chain that forms the handle may be temporarily disengaged from the container, inserted through an aperture of the large, elongated tool, and reattached to the container so as to better secure the tool to the container.

It is an object of the invention to provide a tool storage device adapted to hold an assortment of tools having a wide variety of shapes and sizes.

It is also an object of the invention to provide a tool storage device which holds such tools efficiently and in an organized manner.

Still another object of the present invention is to provide such a tool holder that is conveniently transported without disrupting the tools stored therein.

Further, it is an object of the invention to provide a tool holder that securely holds tools that cannot otherwise effectively fit within the holder.

Other objects, advantages and salient features of the present invention will become apparent from the following detailed description, which, when taken in conjunction with the annexed drawings, disclose preferred embodiments of the present invention.

DETAILED DESCRIPTION OF THE PREFERRED EMBODIMENTS

Figure 1:
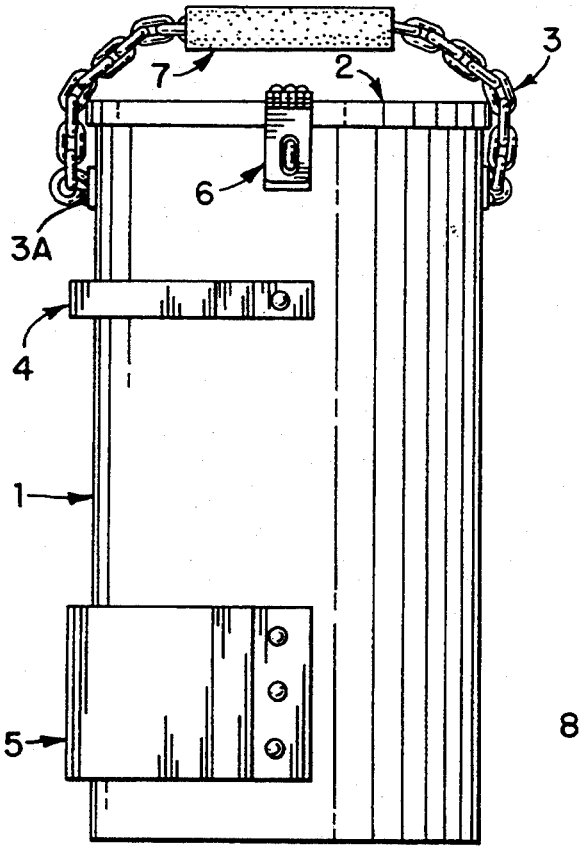
FIG. 1 is a front, exterior view of a preferred embodiment of the present invention.
Figure 2:
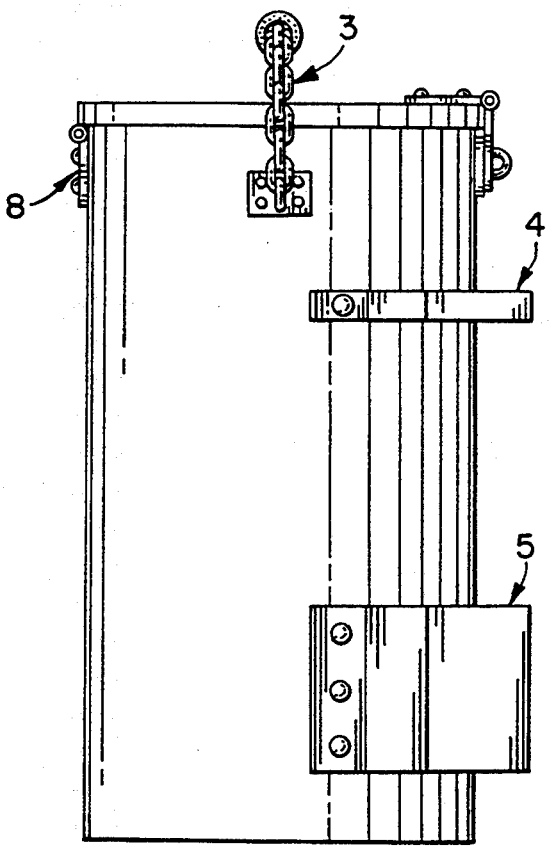
FIG. 2 is a side, exterior view of a preferred embodiment of the present invention.
Figure 3:
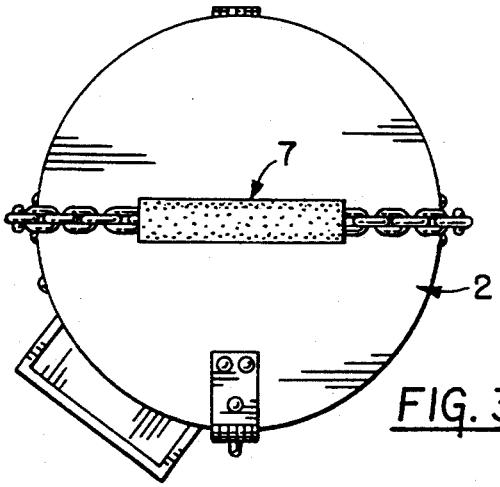
FIG. 3 is a top, exterior view of a preferred embodiment of the present invention.
Figure 4:
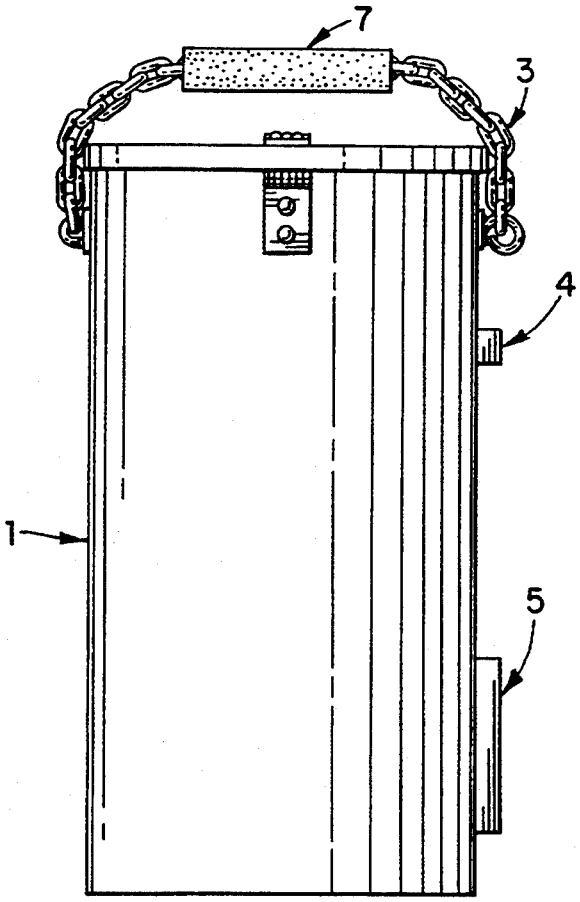
FIG. 4 is a back, exterior view of a preferred embodiment of the present invention.
Figure 5:
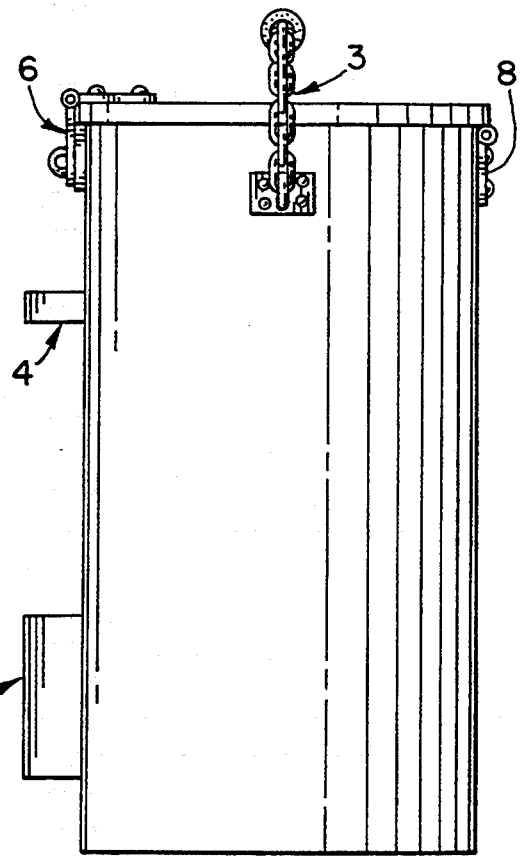
FIG. 5 is a second side, exterior view of a preferred embodiment of the present invention.
Figure 6:
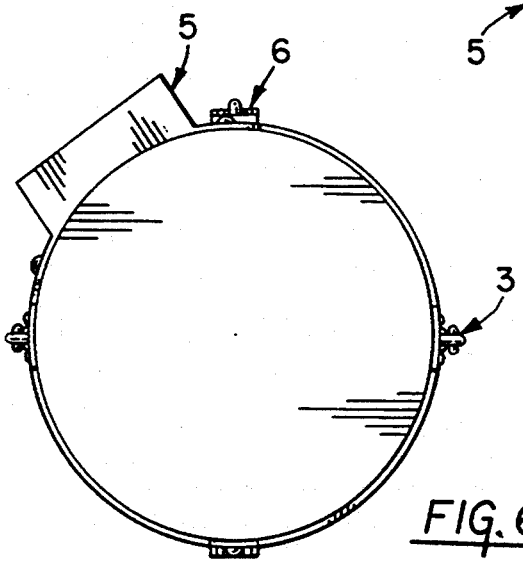
FIG. 6 is a bottom, exterior view of a preferred embodiment of the present invention.

Referring to FIGS. 1–8, there is shown a tool storage device according to the present invention, including container 1, lid 2, handle 3, bracket 4, pocket 5, circular tray 10 and cylindrical shelf 11. The invention is preferably made of a sturdy yet lightweight material such as plastic, polyurethane, or sheet-metal, but it may also be made of other appropriate materials.

Container 1 is preferably substantially cylindrical, but it may alternatively have a rectangular or oval cross-section, depending in part upon the tools it is intended to hold. Further, container 1 may alternatively be widened at the bottom portion thereof relative to its upper portion so as to prevent it from tipping over during transport. Optionally, container 1 is weighted at its bottom portion, or includes laterally disposed feet members extending outwardly from container 1 to prevent tipping over (not shown).

Lid 2 is pivotally attached to container 1 by hinge 8, and is substantially circular so as to substantially provide a water-tight seal therewith. Locking assembly 6, comprising a hasp, attaches to container 1 and lid 2 in order to provide a means for locking the tools within the container by using a padlock or the like.

As shown in FIGS. 1–7, the present invention includes a handle 3 which preferably, but not necessarily, is made of chain. Alternatively, handle 3 is comprised of other strong and substantially flexible materials, such as wire cable. Both ends of handle 3 are preferably attached to container 1 proximal the top thereof and on opposite sides. Optionally, chain 3 may include tubular member 7 defining a handgrip, which slides over chain 3 and is centrally located thereon so as to substantially eliminate discomfort when carrying the device. Tubular member 7 preferably is made of a thick cloth or soft plastic material, but it may alternatively be made of other similar materials.

The present invention includes means for holding and securing larger elongated tools which would not otherwise fit within container 1, such as saws or levels. Such means comprises bracket 4 and pocket 5. Bracket 4 preferably comprises a single piece of material, such as metal or plastic, bent or curved so as to extend substantially outwardly from the exterior of container 1 when both ends of bracket 4 are secured thereto. As shown in FIGS. 1–7, bracket 4 preferably is secured to container 1 at an upper portion thereof. Pocket 5, fabricated of metal, plastic, or the like, is attached to the exterior of container 1 and extends outwardly therefrom. In addition, pocket 5 preferably includes a bottom wall upon which a large elongated tool may rest, and is attached to container 1 at a lower portion thereof. Bracket 4 and pocket 5 preferably are substantially vertically aligned so that as pocket 5 supports an end portion of a large, elongated tool, bracket 4 simultaneously holds a second end thereof substantially against container 1.

Figure 11:
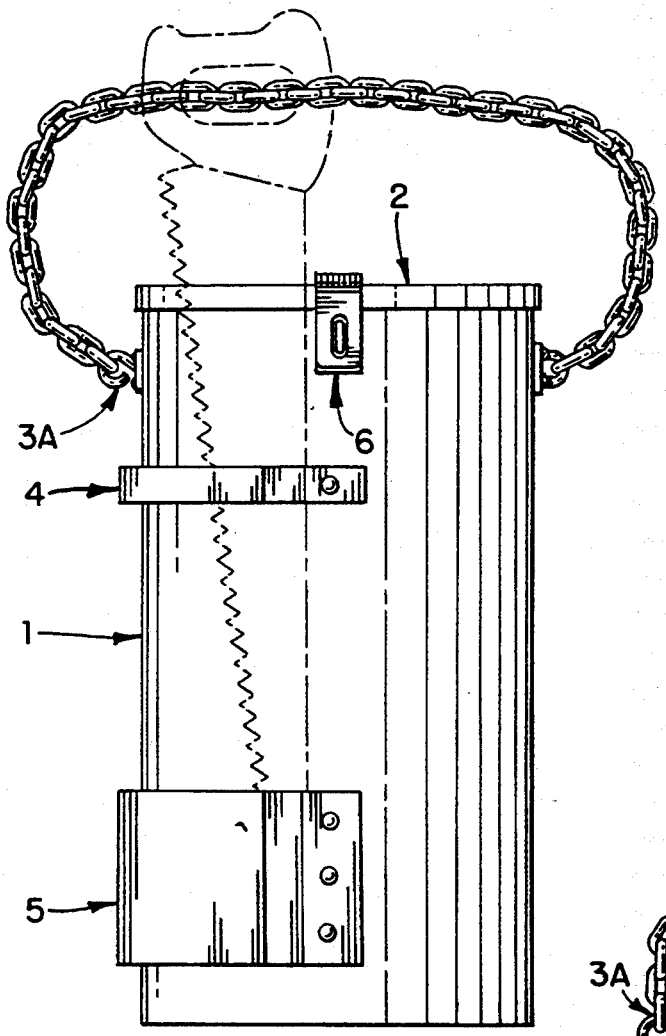
FIG. 11 is a front elevational view of a preferred embodiment of the present invention showing engagement with a tool.

The present invention provides further means for securing a large, elongated tool to container 1. For instance, chain 3, in addition to being secured to container 1 at opposite sides thereof, may additionally include a chain portion that extends from one such secured point. By inserting the chain portion through an aperture of a large, elongated tool, such as through the handle of a saw, and locking the free end of the chain portion to locking assembly 6 or to another chain portion, the tool is securely locked to container 1, as shown in FIG. 11.

Figure 12:
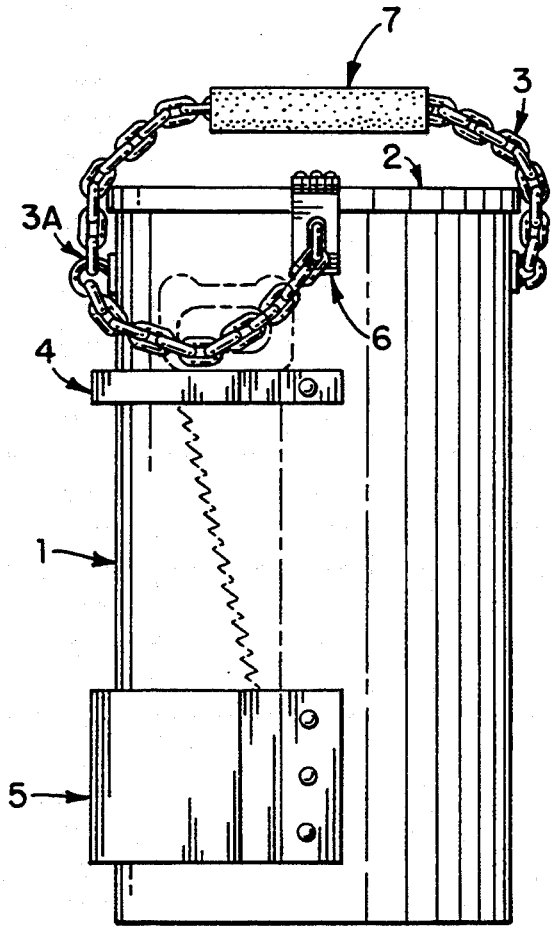
FIG. 12 is a front elevational view of a preferred embodiment of the present invention showing engagement with a tool.

Alternatively, an end 3A of chain 3 (FIG. 1) may be removably attached to container 1 so that it may be disconnected therefrom and inserted through an aperture of the large, elongated tool and thereafter reattached to container 1 so as to further secure the elongated tool to container 1, as shown in FIG. 12.

Cylindrical shelf 11 of the present invention is preferably positioned within a vertically central portion of container 1, and includes outer wall 15 and inner wall 16. Preferably, outer wall 15 closely contacts the inner surface of container 1. In addition, dividers 13 are preferably interposed between outer wall 15 and inner wall 16 so as to provide organization of tools situated in shelf 11 and to hold tools such as pliers, screw drivers, and other elongated tools in substantially upright positions. Shelf 11 may be fabricated of plastic, metal, or any other desired rigid material.

Figure 9:
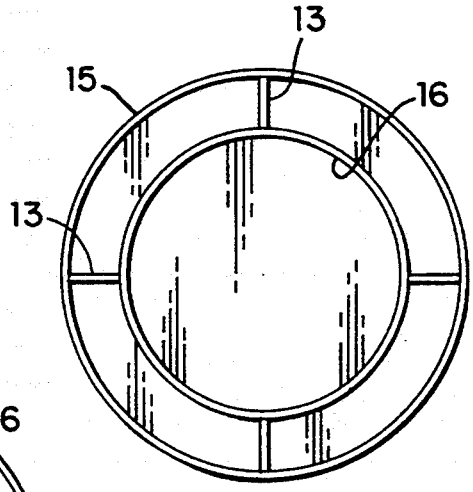
FIG. 9 is a top view of the cylindrical shelf of the preferred embodiment of the present invention taken along the line 9—9 in FIG. 7.
Figure 10:
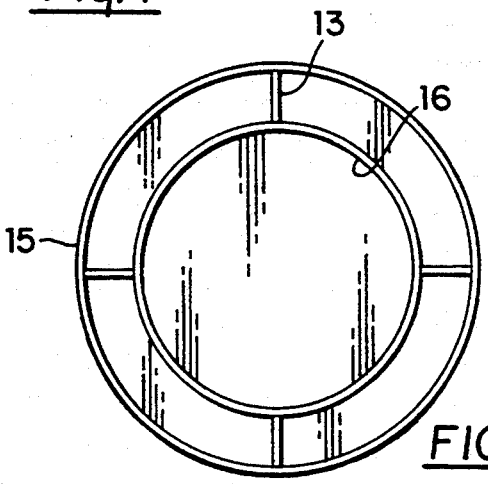
FIG. 10 is a top view of a modified embodiment of the cylindrical shelf shown in FIG. 9.

Further, inner wall 16 is preferably situated at a distance from the center of shelf 11, as shown in FIG. 9, so the flooring of shelf 11 can be preferably cut away between inner wall 16 and the center of shelf 11 as shown in FIG. 10 to define a ring-shaped configuration of shelf 11, in order to allow elongated tools placed in the bottom of container 1 to extend upwardly past the flooring of shelf 11. Alternatively, the flooring of shelf 11 may extend from the center of shelf 11 to inner wall 16, as shown in FIG. 9.

Cylindrical shelf 11 optionally is removable so as to improve the device's storage capability when storing a plurality of large tools. If shelf 11 is desired to be removable, tabs 14 such as described below, or other suitable means such as a lip molded integrally on the inner surface of container 1, may be employed to removably support shelf 11 within container 1. Alternatively, shelf 11 may be fixed within container 1 by any suitable means, such as by integrally molding same with container 1 such that the inner surface of container 1 defines outer wall 15 of shelf 11.

Figure 7:
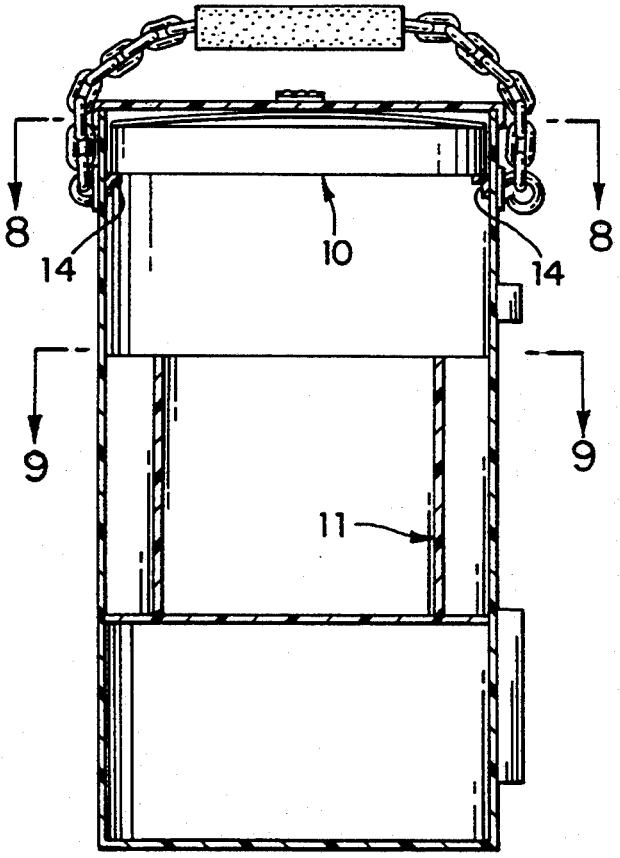
FIG. 7 is an interior view of a preferred embodiment of the present invention.
Figure 8:
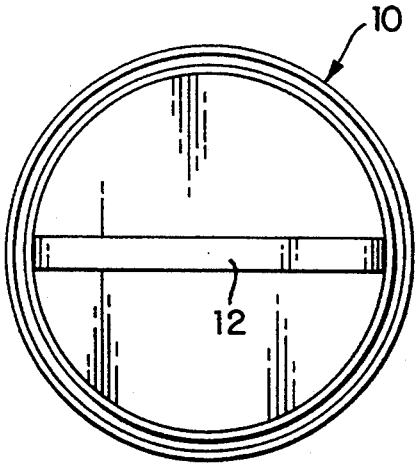
FIG. 8 is a top view of the circular tray of the preferred embodiment of the present invention taken along the line 8—8 in FIG. 7.

According to the present invention, circular tray 10 provides for storage of small tools or similar articles. Tray 10 preferably is situated in an upper portion within container 1 above shelf 11, and rests on tabs 14 so as to be removable therefrom, as shown in FIG. 7. Tray 10 preferably includes handle 12 to provide for easy removal (FIG. 8). Optionally, tray 11 includes a plurality of dividers (not shown) situated therein so as to provide for organized storage of small items. Tray 10 may be fabricated of metal, plastic, or any other desired rigid material.

In use, tray 10 is first removed from container 1. Thereafter, large tools are placed in the bottom of container 1, and elongated tools are placed in cylindrical shelf 11. Next, small tools or related items are placed in tray 10, and tray 10 is placed within container 1 on tabs 14. Large, elongated tools that cannot conveniently fit within container 1 are placed in bracket/pocket assembly 4, 5 by sliding the tools in bracket 4 until one end of the tool rests in pocket 5. Lid 2 is then closed and optionally locked with locking mechanism 6. Additionally, the large, elongated tools carried externally to container 1 may be optionally locked with chain 3, which also aids in facilitating transport of the tool bucket.

By way of example, the dimensions of one preferred embodiment of the invention would be as follows: the outside diameter of container 1, approximately 12 inches; the height of container 1, approximately 22 inches; the height of cylindrical shelf 11, approximately 8 inches; and the distance between the bottom of container 1 and the flooring of shelf 11, approximately 7 inches. It will be understood, however, that such dimensions are exemplary only, and may be modified as desired to accommodate varying sizes and numbers of tools.

Although there have been described what are at present considered to be the preferred embodiments of the present invention, it will be understood that the invention can be embodied in other specific forms without departing from the spirit or essential characteristics thereof. The described embodiments are, therefore, to be considered in all aspects as illustrative, and not restrictive. The scope of the invention is indicated by the appended claims, rather than by the foregoing description.

I claim:

1. A tool holding apparatus, comprising:

a container;

a shelf, located inside said container so as to support tools in substantially upright positions within said container;

a lid pivotally attached to said container;

means, connected to said container, for storing an elongated tool externally to said container;

said external storing means includes a bracket member so as to allow an elongated tool stored by said container to slidably engage therewith, and a pocket member operably cooperating with said bracket member so as to receive an end of the elongated tool slidably engaged with said bracket member;

said apparatus further comprising a chain removably attached to said container at a plurality of locations thereon; and said chain is extended through an aperture of an elongated tool stored externally to said container by said bracket and pocket members so as to secure the tool to said container in a substantially locked engagement therewith.

2. A tool holding apparatus as recited in claim 1, wherein:

said apparatus includes a lid and means for locking said lid to said container in a substantially closed relationship therewith; and said chain selectively engages with said lid locking means so as to secure the elongated tool stored by said external tool storing means.

3. A tool carrying device, comprising:

a container:

means, attached to said container, for holding an elongated tool externally to said container;

means, attached to said container, for holding a tool having any of a number of shapes within said container;

means for substantially locking an elongated tool, which is held by said external tool holding means, to said device;

said external holding means comprises a bracket member so as to allow an elongated tool to slidably engage therewith, and a pocket member cooperating with said bracket member so as to receive an end of the elongated tool which is slidably engaged with said bracket member; and said tool locking means comprises a substantially bendable elongated member which is removably attached to said container and is inserted through an aperture of an elongated tool held by said bracket and pocket members so as to secure the elongated tool to said container.

4. A tool carrying device as recited in claim 3, including:

a lid pivotally connected to said container;

means for locking said lid to said container in a substantially closed relationship therewith; and wherein said bendable elongated member of said tool locking means has a first end which is attached to an outer surface of said container so that said elongated member is selectively inserted through the aperture of the elongated tool held by said external tool holding means, and said elongated member having a second end which is selectively engaged with said lid locking means so as to substantially lock the elongated tool to said container.

5. A tool carrying device as recited in claim 3, wherein:

said bendable elongated member of said tool locking means comprises a handle having at least one end thereof which is removably attached to said container at a first location thereon;

and said bracket member being positioned proximal to said first location so that a portion of said handle is selectively inserted through the aperture of the elongated tool received by said bracket member, and reattached to said container so as to substantially lock the elongated tool to said container.

6. A tool carrying device as recited in claim 3, including:

a lid member which selectively covers an opening of said container in a selectively substantially locked engagement therewith;

a handle member attached to said container at a plurality of locations thereon; and said bendable elongated member having one end which is attached to said container at one of said handle member attachment locations, and having a second end which is selectively inserted through the aperture defined in the externally-held elongated tool and selectively engaged with said lid member so as to substantially lock the elongated tool to said container.

7. A tool holding apparatus, comprising:

a container;

a shelf disposed within said container, having an inner wall, an outer wall, and flooring;

means for holding an elongated tool externally to said container, including a bracket member attached along an outer surface of said container, and a pocket member attached to an outer surface of said container and situated in substantial alignment with said bracket member so as to hold an end portion of the elongated tool; and a substantially bendable handle removably attached to said container, a portion of said handle being inserted through an aperture of an elongated tool held externally to said container by said bracket and pocket members, so as to secure the elongated tool to said container.

8. A tool holding apparatus as recited in claim 7, wherein:

said handle is attached to said container at a plurality of locations thereon; and said handle being selectively removed from said container at at least one of said locations on said container in order to insert said portion of said handle through the aperture of the elongated tool externally held by said bracket member and said pocket member.

9. A tool holding apparatus as recited in claim 7, wherein:

said apparatus includes a lid and a means for locking said lid to said container;

said handle is attached to said container at a plurality of locations along an outer surface thereof; and said portion of said handle extends from one of said locations and selectively engages with said locking means following the selective insertion of said handle portion through the aperture of the elongated tool externally held by said bracket member and said pocket member so as to substantially lock the elongated tool to said container.

* * * * *